US008637228B1

(12) United States Patent
Hendricks, III et al.

(10) Patent No.: US 8,637,228 B1
(45) Date of Patent: Jan. 28, 2014

(54) COLOR PHOTOGRAPHIC SILVER HALIDE PAPER AND USE

(71) Applicants: Jess B. Hendricks, III, Rochester, NY (US); Paul L. Zengerle, Rochester, NY (US); Andrew D. Church, Pinner (GB); Darrell B. Austin, Rochester, NY (US)

(72) Inventors: Jess B. Hendricks, III, Rochester, NY (US); Paul L. Zengerle, Rochester, NY (US); Andrew D. Church, Pinner (GB); Darrell B. Austin, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 13/671,939

(22) Filed: Nov. 8, 2012

(51) Int. Cl.

| | |
|---|---|
| ***G03C 7/00*** | (2006.01) |
| ***G03C 1/46*** | (2006.01) |
| ***G03C 1/815*** | (2006.01) |
| ***G03C 1/825*** | (2006.01) |
| ***G03C 1/76*** | (2006.01) |
| ***G03C 1/005*** | (2006.01) |
| ***G03C 1/494*** | (2006.01) |

(52) U.S. Cl.
USPC ..... 430/393; 430/357; 430/374; 430/375; 430/507; 430/510; 430/523; 430/531; 430/533; 430/536; 430/537; 430/502; 430/503; 430/567

(58) Field of Classification Search
USPC ..... 430/357, 374, 375, 393, 502, 503, 507, 430/510, 523, 531, 533, 536, 537, 567
See application file for complete search history.

(56) References Cited

U.S. PATENT DOCUMENTS

| | | | | |
|---|---|---|---|---|
| 2,719,791 | A | 10/1955 | Land | |
| 2,751,315 | A | 6/1956 | Staehle | |
| 2,956,877 | A | 10/1960 | Land | |
| 3,895,949 | A | 7/1975 | Akamatsu et al. | |
| 4,142,894 | A * | 3/1979 | Hori et al. | 430/351 |
| 4,232,117 | A * | 11/1980 | Naoi et al. | 430/539 |
| 4,777,113 | A | 10/1988 | Inoue et al. | |
| 4,914,012 | A | 4/1990 | Kawai | |
| 5,310,639 | A | 5/1994 | Lushington et al. | |
| 5,376,434 | A | 12/1994 | Ogawa et al. | |
| 5,786,135 | A | 7/1998 | Anderson et al. | |
| 5,846,699 | A | 12/1998 | Wang et al. | |
| 5,866,312 | A | 2/1999 | Wang et al. | |
| 5,952,130 | A | 9/1999 | Yau et al. | |
| 5,962,210 | A | 10/1999 | Hahm et al. | |
| 5,965,304 | A | 10/1999 | Yau et al. | |
| 6,218,094 | B1 | 4/2001 | den Zegel et al. | |
| 6,221,546 | B1 | 4/2001 | Yau et al. | |
| 6,303,281 | B1 | 10/2001 | Wang et al. | |
| 6,312,858 | B1 | 11/2001 | Yacobucci et al. | |
| 6,555,301 | B2 * | 4/2003 | Smith et al. | 430/434 |

* cited by examiner

*Primary Examiner* — Geraldina Visconti
(74) *Attorney, Agent, or Firm* — Hogan Lovells USLLP

(57) ABSTRACT

A color photographic element has a reflective support and a blue light sensitive color record, a green light sensitive color record, and a red light sensitive color record and can be used to provide color photographic prints. The element also has a non-light sensitive layer over the red light sensitive color record. This non-light sensitive layer has (1) a hydrophilic colloid in an amount of at least 200 mg/m$^2$ to and including 2,000 mg/m$^2$, (2) matte particles, and (3) an acrylate latex polymer having latex particles having an average size of less than 1 μm and a glass transition temperature of at least 70° C. The dry weight ratio of the acrylate latex polymer to the hydrophilic colloid is at least 0.8:1 and the dry weight ratio of the acrylate latex polymer to the total matte particles is at least 15:1.

18 Claims, No Drawings

COLOR PHOTOGRAPHIC SILVER HALIDE PAPER AND USE

FIELD OF THE INVENTION

This invention relates to silver halide color photographic elements that are useful as color photographic papers for providing positive photographic color images. The silver halide color photographic elements exhibit improved scratch resistance especially when the color print images are mounted in photobooks.

BACKGROUND OF THE INVENTION

The subtractive process of color formation is customarily employed in multi-colored photographic elements. The resulting yellow, magenta, and cyan image dyes are formed in silver halide layers that are sensitive to blue, green, and red radiation, respectively. It is known in the photographic art that these color images are customarily obtained by a coupling reaction between an oxidized aromatic primary amine developer and appropriate color-forming dye image forming color couplers.

A typical silver halide color photographic element contains multiple layers of light-sensitive photographic silver halide emulsions that are sensitized to the appropriate actinic radiation. For example, the appropriate yellow, magenta, and cyan dye images are generally provided in the photographic element as separate blue light sensitive, green light sensitive, and red light sensitive color records comprising the appropriate dye image forming color couplers, all of which color records are applied or coated onto suitable supports such as resin-coated paper supports. The elements generally have an outermost non-light sensitive overcoat used to protect the imaged layers from scratches, fingerprints and other objectionable effects. Typical overcoats are described for example in U.S. Pat. No. 5,962,210 (Hahm et al.).

Latex polymers have been incorporated into photographic elements for various purposes. For example, they have been incorporated into light sensitive silver halide emulsion layers and in backside (non-imaging) layers, of black-and-white and color photographic elements.

U.S. Pat. No. 5,310,639 (Lushington et al.) describes the use of low glass transition temperature polymers in non-light sensitive stress absorbing layers in color negative photographic films to reduce pressure fog while maintaining scratch resistance.

Protective overcoats containing a mixture of polymeric particles (5-500 nm), some having a glass transition temperature ($T_g$) greater than or equal to 25° C. and other having a glass transition temperature less than 25° C. and wax particles is described for imaged color prints in U.S. Pat. No. 5,965,304 (Yau et al.).

Low $T_g$ polymer latices are described for use in protective overcoats of color photographic materials in U.S. Pat. No. 6,221,546 (Yau et al.), and higher $T_g$ polymers are discouraged.

Protective polycarbonate-polyurethane overcoats are described for use in image recording elements in U.S. Pat. No. 6,312,858 (Yacobucci et al.).

Color silver halide photographic papers or reflective prints have been commonly put into wedding and family albums and on walls and desks for generations. As the industry has wrestled with shrinking volumes and uses of traditional photographic prints, it has found new ways to display and store photographic color prints. One of those ways is what is known as "photobooks" in which one or more reflective color photographs or "prints" are bound and displayed in book form with each image typically covering opposing pages of the photobook.

Color photographic prints incorporated into photobooks are generally thinner than most color photographic prints marketed for the general consumer market. The thinner color photographic prints are achieved using thinner resin-coated paper supports. The photobook color photographic prints also generally comprise a topcoat or overcoat that contains various matte particles as filler to reduce friction when photobooks are rubbed together. These color photographic prints can be designed for either matte or glossy finishes.

When glossy color photographic prints having thin supports are incorporated into photobooks, the rollers and other manufacturing equipment can scratch or otherwise damage on the glossy side of the color photographic prints. The glossiness can also be reduced.

Thus, there is a need to solve this problem in reflective color photographic elements (color prints) that are particularly useful for incorporation into photobooks.

SUMMARY OF THE INVENTION

The present invention provides a color photographic element comprising a reflective support, and having on one side thereof and in order from the reflective support:

a blue light sensitive color record comprising a blue light sensitive silver halide emulsion layers comprising a hydrophilic colloid and a yellow dye image forming color coupler, a first non-light sensitive interlayer comprising a hydrophilic colloid, a green light sensitive color record comprising a green light sensitive silver halide emulsion layer comprising a hydrophilic colloid and a magenta dye image forming color coupler, a second non-light sensitive interlayer comprising a hydrophilic colloid, a red light sensitive color record comprising a light sensitive silver halide emulsion layer comprising a hydrophilic colloid and a cyan dye image forming color coupler, and a non-light sensitive layer comprising:

(1) a hydrophilic colloid in an amount of at least 200 mg/m$^2$ to and including 2,000 mg/m$^2$, (2) matte particles, and (3) an acrylate latex polymer having latex particles having an average size of less than 1 μm and a glass transition temperature of at least 70° C., wherein the dry weight ratio of the acrylate latex polymer to the hydrophilic colloid is at least 0.8:1 and the dry weight ratio of the acrylate latex polymer to the total matte particles is at least 15:1.

This invention also provides a method for providing a color photographic print, comprising:

imagewise exposing the color photographic element of any embodiment of this invention to provide an imagewise exposed color photographic element having a latent color positive image, and developing, bleach-fixing, and rinsing the imagewise exposed color photographic element to provide a color positive image from the latent color positive image.

It was found that the present invention solves the problem of scratching and damaging the color photographic prints that are incorporated into photobooks. The particular combination of hydrophilic colloid, matte particles, and high $T_g$ acrylic polymer latex provides an improved non-light sensitive overcoat. In some embodiments, the weight ratio of the matte particles and the acrylic latex can be adjusted to provide further improvements in improved scratch resistance without a loss in $D_{max}$ in color images.

Further advantages of the present invention can be observed by consideration of the following details of the present invention.

DETAILED DESCRIPTION OF THE INVENTION

Definitions

As used herein to define various components of the layers in the color photographic elements, color photographic developers, and formulations, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Unless otherwise indicated, the terms "color photographic element", "photographic element", "color photographic print", "element" and similar terms are used to refer to embodiments of the present invention.

The term "blue light" generally refers to radiation within the range of at least 400 nm to and including 500 nm.

The term "green light" generally refers to radiation within the range of at least 500 nm to and including 600 nm.

The term "red light" generally refers to radiation within the range of at least 600 nm to and including 700 nm.

The term "high chloride" in referring to silver halide grains and emulsions is used to indicate an overall chloride concentration of at least 80 mol %, based on the total silver in the silver halide grain or emulsion.

In referring to silver halide grains and emulsions containing two or more halides, the halides are named in their order of ascending concentrations.

Silver halide grains and emulsions having named halides can further contain impurity or functionally insignificant levels of one or more unnamed halides (that is, less than 1 mol % based on the total silver).

The term "cubic grain" is used to define a silver halide grain that is bounded by six {100} crystal faces. Typically, the corners and edges of the silver halide grains show some rounding due to ripening, but no identifiable crystal faces other than the six {100} crystal faces. The six {100} faces form three pairs of parallel {100} faces that are equidistantly spaced.

Research Disclosure refers to a publication by Kenneth Mason Publications, Ltd., Dudley House, 12 North Street, Emsworth, Hampshire P010 7DQ, England.

Color Photographic Elements

The present invention is directed to a color photographic element comprising a reflective support that can be particularly imaged to provide imaged multicolor prints. In general, such reflective supports include but are not limited to polymeric films that are filled with opacifying agents, cellulosic materials such as papers, and resin-coated papers having a layer of reflective pigment (such as titanium dioxide or barium sulfate).

In general, the dry thickness of a useful support is at least 120 μm and to and including 300 μm and typically at least 160 μm and to and including 270 μm. In some embodiments, a resin-coated reflective support can be relatively thin and have a dry thickness of at least 150 μm and typically at least 160 μm and to and including 180 μm.

Disposed on one side of the reflective support, in order, are at least a blue light sensitive color record, a first non-light sensitive interlayer, a green light sensitive color record, a second non-light sensitive layer, a red light sensitive color record, and at least one non-light sensitive layers disposed over the red light sensitive color record. These non-light sensitive layers can be protective overcoats or UV absorbing layers, or have both functions. The non-light sensitive layers that are designed for the present invention are described below. In most embodiments, the non-light sensitive layer designed for the present invention is the outermost non-light sensitive layer in the color photographic element so that it is the first layer that is impacted by imaging radiation.

Each light sensitive color record comprises one or more silver halide emulsion layers, each silver halide emulsion layer comprising one or more hydrophilic colloids and appropriate dye image forming color couplers, all defined below. In addition, each silver halide emulsion layer also comprises desired silver halide grains and other photographic addenda that provide the desired light sensitivity.

The silver halide emulsion layers used in the present invention generally comprise silver halide grains that comprise at least 50 mol % of chloride and typically they are high chloride silver halide grains or even have at least 80 mol % chloride, or more likely at least 90 mol % chloride, based on total silver. The remaining halide can be bromide or iodide but the silver halide grains generally comprise at least 0.1 mol % to and including 5 mol % of iodide (or up to 2 mol %), based on total silver. Any portion of the halide that is not chloride and iodide is then bromide and such silver halide grains generally have up to 20 mol % bromide, based on total silver.

In many embodiments or the color photographic element of this invention, the blue light sensitive silver halide emulsion layers, green light sensitive silver halide emulsion layers, and red light sensitive silver halide emulsion layers comprise the same or different silver halide grains comprising at least 90 mol % chloride, based on the total grain silver.

In still other embodiments of this invention, each of the blue light sensitive silver halide emulsion layers, green light sensitive silver halide emulsion layers, and red light sensitive silver halide emulsion layers comprise the same or different silver halide grains comprising at least 95 mol % chloride, based on the total grain silver.

In other embodiments of this invention, each of the blue light sensitive silver halide emulsion layers, green light sensitive silver halide emulsion layers, and red light sensitive silver halide emulsion layers comprise the same or different silver halide grains comprising at least 90 mol % chloride, and up to 2 mol % of iodide, both based on the total grain silver.

In most embodiments, each of the color records comprises a single silver halide emulsion layer.

Most likely, the color photographic elements of this invention comprise:

a blue light sensitive color record that comprises a single blue light sensitive silver halide emulsion layer comprising a gelatin as the hydrophilic colloid, one or more yellow dye image forming color couplers, and silver halide grains having at least 95 mol % chloride and up to 2 mol % of iodide, based on the total grain silver, a green light sensitive color record that comprises a single green light sensitive silver halide emulsion layer comprising a gelatin as the hydrophilic colloid, one or more magenta dye image forming color couplers, and silver halide grains having at least 95 mol % chloride and up to 2 mol % of iodide, based on the total grain silver, a red light sensitive color record that comprises a single red light sensitive silver halide emulsion layer comprising a gelatin as the hydrophilic colloid, one or more cyan dye image forming color couplers, and silver halide grains having at least 95 mol % chloride and up to 2 mol % of iodide, based on the total grain silver, and the outermost non-light sensitive layer designed for this invention.

Useful silver halide grains and methods for making them, with and without specific dopants (such as iridium, osmium, ruthenium, or rhodium complex dopants), and useful chemical and spectral sensitizers, are known in the art and described for example in U.S. Pat. Nos. 5,962,210 (Hahm et al.) and 6,242,172 (Budz et al.), both incorporated herein by reference, and in *Research Disclosure*, Item 38957 published September 1996 and Item 437013 published September 2000. In most embodiments, the silver halide grains used in the silver halide emulsion layers are cubic silver halide grains. The silver halide emulsions can be prepared to have silver halide grains in any mean grain size known to be useful. Mean grain sizes are generally in the range of at least 0.15 μm to and including 2.5 μm. Gold and sulfur chemical sensitizers are generally used to improve photographic speed and to reduce fogging. The silver halide grains can be sensitized using dyes from a variety of classes including but not limited to polymethine dyes such as cyanines and merocyanines, styryls, merostyryls, stretocyanines, hemicyanines, arylidenes, allopolar cyanines, and enamine cyanines. Combinations of spectral sensitizing dyes can be used for what is known as supersensitization as described for example by Gilman, *Photographic Science and Engineering*, Vol. 18, 1974, pp. 418-430.

Each silver halide emulsion layer can comprise one or more different silver halide emulsions (a blended emulsion layer), each silver halide emulsion comprising suitable silver halide grains of a defined halide composition, and various addenda. Thus, the one or more of the silver halide emulsion layers can comprise a mixture of different silver halide grains, or they can comprise essentially the same silver halide grains uniformly distributed throughout the layer.

The amount of silver in the color photographic element of this invention can vary depending upon its use, desired sensitivity, and other features known in the art. In general, the color photographic element comprises less than 2000 mg/m$^2$ of total silver and this amount is divided among the silver halide emulsion layers. In many embodiments, the amount of total silver is at least 100 mg/m$^2$ to and including 1200 mg/m$^2$. It is not usual that the amount of silver is the same in each silver halide emulsion layer. In general, the amount of silver in the blue light sensitive color record is less than 500 mg/m$^2$, the amount of silver in the green light sensitive color record is less than 200 mg/m$^2$, and the amount of silver in the red light sensitive color record is less than 500 mg/m$^2$.

The hydrophilic colloids useful in the present invention can be the same or different in the various layers. Useful hydrophilic colloids include but are not limited to, gelatin and modified gelatins (also known as gelatin derivatives) including acetylated gelatin, phthalated gelatin, and other naturally occurring and synthetic hydrophilic materials that are known in the art. Such materials can also be readily hardened using known hardeners as is common practice in the photographic art to reduce the absorption of water during processing of the imaged elements.

In most embodiments, the silver halide emulsion layers and non-light sensitive layers generally comprise a gelatin or gelatin derivative as the hydrophilic colloid that can be modified using one or more hardeners. These silver halide emulsion layers can also include various vehicles, vehicle extenders, and other addenda known in the art, for example as described in the *Research Disclosure* publication noted above.

The various light sensitive color records used in the color photographic elements also comprise one or more dye image forming color couplers, specific to the light sensitivity and color desired for a given color record. Thus, the blue light sensitive color record comprises one or more yellow dye image forming color couplers, the green light sensitive color record comprises one or more magenta dye image forming color couplers, and the red light sensitive color record comprises one or more cyan dye image forming color couplers. In any of the color records, the one or more dye image forming color couplers can be present in the same or different silver halide emulsion layer. In most embodiments, each color record comprises a single silver halide emulsion layer containing all dye image forming color couplers ("couplers") needed for that color record. These dye image forming color couplers form appropriate image dyes upon reaction with oxidized color developing agent provided during photographic processing.

Coupling-off groups can determine the chemical equivalency of a coupler, that is, whether it is a 2-equivalent or a 4-equivalent coupler, or to modify the reactivity of the coupler. Such groups can advantageously affect the silver halide emulsion layer in which the image-forming coupler is located, or other layers in the color photographic element, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766, the disclosure of which are incorporated herein by reference, and in GB published applications 1,466,728, 1,531,927, 1,533,039, 2,006,755A and 2,017,704A.

Dye image forming color couplers that form cyan dyes upon reaction with oxidized color developing agents are described for example, in U.S. Pat. Nos. 2,367,531, 2,423,730, 2,474,293, 2,772,162, 2,895,826, 3,002,836, 3,034,892, 3,041,236, 4,333,999, 4,883,746, and 5,256,526 all of which are incorporated herein by reference, and in "Farbkupplereine LiteratureUbersicht," published in Agfa Mitteilungen, Band III, pp. 156-175 (1961). Usually such dye image forming color couplers are phenols, naphthols, and pyrazolotriazoles that form cyan dyes upon reaction with oxidized color developing agent. Other useful cyan dye image-forming couplers are described in U.S. Pat. No. 7,153,640 (Zengerle et al.) that is incorporated herein by reference.

Dye image forming color couplers that form magenta dyes upon reaction with oxidized color developing agent are described in U.S. Pat. Nos. 2,311,082, 2,343,703, 2,369,489, 2,600,788, 2,908,573, 3,062,653, 3,152,896, 3,519,429, 3,758,309, and 4,540,654, all of which are incorporate herein by reference, and in "Farbkuppler-eine LiteratureUbersicht," published in Agfa Mitteilungen, Band III, pp. 126-156 (1961). Usually such dye image forming color couplers are pyrazolones, pyrazolotriazoles, or pyrazolobenzimidazoles that form magenta dyes upon reaction with oxidized color developing agents.

Dye image forming color couplers that form yellow dyes upon reaction with oxidized and color developing agent are described in U.S. Pat. Nos. 2,298,443, 2,407,210, 2,875,057, 3,048,194, 3,265,506, 3,447,928, 4,022,620, 4,443,536, 4,840,884, 5,447,819, 5,457,004, 5,998,121, 6,132,944, and 6,569,612, all of which are incorporated herein by reference, and in "Farbkuppler-eine LiteratureUbersicht," published in Agfa Mitteilungen, Band III, pp. 112-126 (1961). Such dye image forming color couplers are typically open chain ketomethylene compounds.

U.S. Pat. No. 5,962,210 (Hahm et al.) is also incorporated herein by reference to provide further details about cyan, magenta, and yellow dye image forming color couplers that are useful in the present invention.

These dye image forming color couplers can be incorporated into the various silver halide emulsion layers in amounts that are known in the art.

Polymer containing dye image forming color couplers compositions or dispersions can be prepared by emulsifying a mixed oil emulsion containing a suitable coupler solvent and the dye image forming color coupler(s).

Typically, dye image forming color couplers are incorporated into each silver halide light sensitive emulsion layers in a mole ratio to silver of at least 0.05:1 and up to and including 1:1, or typically at least 0.1:1 and up to and including 0.5:1. Usually the dye image forming color couplers are incorporated as dispersions in one or more hydrophobic organic solvents (sometimes called "permanent" solvents, "high boiling" coupler solvents), in a weight ratio of coupler solvent to image-forming coupler of at least 0.1:1 and up to and including 10:1, and typically of at least 0.1:1 and up to and including 2:1 although dispersions using no coupler solvent are sometimes employed.

A dye image forming color coupler dispersion contains one or more dye image forming color couplers in a stable, finely divided state in a coupler solvent that is stabilized by suitable surfactants or surface active agents usually in combination with a binder or matrix such as gelatin or a gelatin derivative. The dispersion can contain one or more coupler solvents that dissolve the materials and maintain them in a liquid state. Some examples of suitable coupler solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, orthomethylphenyl benzoate, trioctylamine and 2-ethylhexylphosphate. Useful classes of coupler solvents are carbonamides, phosphates, phenols, alcohols, and esters. When a coupler solvent is present in the silver halide emulsion layer, it is usual that the weight ratio of dye image forming color coupler to coupler solvent of at least 1:0.5, or at least 1:1. The dispersion can contain an auxiliary coupler solvent initially to dissolve the dye image forming color coupler but this auxiliary coupler solvent is removed afterwards, usually either by evaporation or by washing with additional water. Some examples of suitable auxiliary coupler solvents are ethyl acetate, cyclohexanone and 2-(2-butoxyethoxy)ethyl acetate. The dispersion can also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC, sodium dodecyl benzene sulfonate, and saponin. The dye image forming color couplers can also be dispersed as an admixture with another component of the system such as a dye image forming color coupler or an oxidized developer scavenger so that both are present in the same oil droplet. It is also possible to incorporate the dye image forming color couplers as a solid particle dispersion; that is, a slurry or suspension of finely ground (through mechanical means) compound. These solid particle dispersions can be additionally stabilized with surfactants or polymeric materials as known in the art. Additional coupler solvents can be added to the solid particle dispersion to help increase activity. Polymers that can be used in color coupler dispersions are described in U.S. Pat. No. 5,962,210 (noted above) that is incorporated herein by reference.

The term "high boiling organic solvent" is used herein to refer to coupler solvents having a boiling point above 150° C. Such coupler solvents have sufficient carbon atoms so that they have a sufficient molecular weight to prevent excessive solvent migration between layers in the element. The coupler solvents are also liquids at 37° C. that is a typical processing (development) temperature. Particularly useful high boiling coupler solvents include tricresylphosphate, N,N-diethyllauramide, N,N-dibutyllauramide, p-dodecylphenol, dibutylphthalate, di-n-butyl sebacate, 2-hexyl-1-decanol, tri(2-ethylhexyl)phosphate, 2,4-di-t-pentylphenol, and triphenylphosphate. Mixtures of high boiling organic solvents are also useful. Other useful coupler solvents are described in U.S. Pat. Nos. 4,540,657 (Krishnamurthy), 4,684,606 (Krishnamurthy), and 5,405,736 (Young) all of which are incorporated herein by reference.

Each silver halide emulsion layer of the color photographic element can also have useful dye hue modifiers and image dye stabilizers as described in the *Research Disclosure* publications noted above.

The color photographic elements generally comprise one or more non-light sensitive interlayers disposed between two adjacent color records. Thus, a first non-light sensitive interlayer is generally present between the blue light sensitive color record and the green light sensitive color record, and a second non-light sensitive interlayer is generally present between the green light sensitive color record and the red light sensitive color record.

Such non-light sensitive interlayers generally include one or more oxidized color developing agent scavengers (such as ballasted hydroquinones or aminophenols), ultraviolet absorbers, or both types of compounds. The amounts of such compounds are well known in the art.

In addition, each non-light sensitive interlayer has one or more hydrophilic colloids (such as a gelatin) present in an amount sufficient to provide a total dry layer coverage of at least 200 mg/m$^2$, or at least 200 mg/m$^2$ to and including 2,000 mg/m$^2$. Useful hydrophilic colloids, such as gelatin and gelatin derivatives, are known in the art, as described above for the silver halide emulsion layers.

In some embodiments, it is also useful to include one or more acrylic latex polymers (or acrylate latex polymers) in one or both interlayers, for a total dry amount of at least 20 mg/m$^2$ to and including 2,000 mg/m$^2$, and typically in a total dry amount of at least 50 mg/m$^2$ to and including 500 mg/m$^2$.

It is also useful that the dry weight ratio of the hydrophilic colloid (such as a gelatin) to one or more acrylic latex polymers is at least 2.25:1 and up to and including 12:1, or typically at least 3:1 to and including 10:1.

In general, the acrylic latex polymers useful in this manner, especially in the second non-light sensitive interlayer, have a glass transition temperature ($T_g$) of at least −80° C. and less than 0° C., or more typically of at least −50° C. and to and including −10° C. Each of the acrylic latex polymers has a $T_g$ within this range, but if a mixture of acrylic latex polymers is used, the mixture has a composite $T_g$ within the noted range even if one or more of the acrylic latex polymers has an individual $T_g$ outside the range. A skilled worker would know how to adjust the acrylic latex polymers in the mixture to achieve the desired composite $T_g$. For purposes of this invention, the glass transition temperature of the acrylic latex polymers can be determined using Differential Scanning calorimetry. Some polymer glass transition temperature values are known in the literature.

Each of the acrylic latex polymers useful in interlayers generally comprises at least 50 weight % of recurring units (or repeating units) derived from one or more acrylic esters or methacrylic esters, based on the total dry weight of the recurring units. The acrylic ester monomers used for providing these recurring units can be conveniently provided by reacting acrylic acid or methacrylic acid with an alcohol, phenol, or hydroxy substituted ether. The useful polymerizable acrylates generally have up to 20 carbon atoms in the ester groups, or from 1 to 10 carbon atoms, or more likely 2 to 6 carbon atoms.

The acrylic latex polymers can comprise two or more different types of recurring units, in random order, and as noted above, more than 50 weight %, and typically at least 80 weight %, or even at least 90 weight %, of the recurring units are derived from one or more acrylic or methacrylic acid ester ethylenically unsaturated polymerizable monomers. In particular, the acrylic acid or methacrylic acid esters that are capable of providing homopolymers having a $T_g$ of less than 0° C. are useful.

Examples of useful ethylenically unsaturated polymerizable monomers of this type are described for example, in Columns 4 and 5 of U.S. Pat. No. 5,310,639 (noted above) that is incorporated herein by reference.

Other useful ethylenically unsaturated polymerizable monomers that can provide up to 50 weight %, or up to 20 weight %, or even up to 10 weight % of the total weight of recurring units can be any of those monomers described in Cols. 5-9 of U.S. Pat. No. 5,310,639 (noted above).

The non-light sensitive interlayers can also comprise one or more high boiling organic coupler solvents in a total high boiling organic coupler solvent amount greater than 100 mg/m$^2$, based on the total non-light sensitive interlayer dry weight. The weight ratio of hydrophilic colloid to high boiling organic coupler solvent is generally at least 1:1 and typically at least 2:1 in each non-light sensitive interlayer.

Such high boiling coupler solvents include one or more carbonamides, phosphates, phenols, alcohols, or esters, and particularly useful high boiling coupler solvents are described above in relation to the silver halide emulsion layers.

Overcoat Layers

The color photographic elements include one or more non-light sensitive protective overcoats disposed over the red light sensitive color record. Such non-light sensitive protective overcoats are generally transparent and can also comprise one or more hydrophilic gelatin colloids, vehicles, and other addenda commonly employed for various purposes, such as ultraviolet light absorbers, optical dyes or brighteners, particulate matting agents, plasticizers, lubricants, surfactants, and antistatic agents, all of which are also described in the noted *Research Disclosure* publications.

As noted above, the best embodiments of this invention comprise an outermost non-light sensitive layer that comprises:

(1) A hydrophilic colloid (such any of those described above for other layers) in an amount of at least 200 mg/m$^2$ to and including 2,000 mg/m$^2$, or more likely in an amount of at least 200 mg/m$^2$ to and including 1,000 mg/m$^2$, especially when the hydrophilic colloid is a gelatin.

(2) Matte particles, for example having an average size of at least 1 μm and up to and including 15 or more typically at least 2 μm to and including 12 μM. Specific useful matte particles are described below.

(3) One or more acrylate latex polymers, each having latex particles having an average size of less than 1 μm, and typically having an average size of at least 0.05 μm to and including 0.8 μm, and a glass transition temperature of at least 70° C., wherein the dry weight ratio of the total acrylate latex polymers to the hydrophilic colloid is at least 0.8:1 and the dry weight ratio of the total acrylate latex polymers to the total matte particles is at least 15:1.

Details of these features are now described.

In general, the one or more acrylate latex polymers are present in the non-light sensitive layer in an amount of at least 200 mg/m$^2$ to and including 2,000 mg/m$^2$, and typically at least 400 mg/m$^2$ to and including 1,000 mg/m$^2$.

Each of the acrylate latex polymers in the non-light sensitive layer has a glass transition temperature ($T_g$) of at least 70° C. and up to and including 200° C., or more likely at least 70° C. and up to and including 150° C. For purposes of this invention, the glass transition temperature of the acrylic latex polymers can be determined using Differential Scanning calorimetry. Some polymer glass transition temperature values are known in the literature.

In addition, the dry weight ratio of the total acrylate latex polymers described above to the hydrophilic colloid is at least 0.8:1 and generally at least 1:1 to and including 3:1.

Moreover, the dry weight ratio of the total acrylate latex polymers as described above to the total matte particles is at least 10:1 and typically at least 20:1 to and including 50:1, or more likely at least 30:1 to and including 40:1.

The matte particles are generally inorganic particles or crosslinked organic polymeric particles having an average size of at least 1 μm to and including 15 μm, and more likely at least 2 μm to and including 12 μm.

Useful inorganic particles include those generally used in overcoat layers in photographic materials, including but not limited to, silica, talc, calcium carbonate, and other known inorganic materials.

Particularly useful matte particles are composed of crosslinked polymers that can be derived from one or more ethylenically unsaturated polymerizable monomers including one or more of such monomers that have crosslinkable sites such as multiple vinyl groups. Such polymeric particles are readily prepared using known reactants and polymerization conditions and some can be purchased from commercial sources. For example, useful matte particles are composed of various acrylic monomers, comparable nitriles and amides, vinyl aromatic monomers such as styrenes, and crosslinking monomers such as polyacrylates, dienes, and polyfunctional aromatic compounds such as divinyl benzene and other monomers that have crosslinkable functional groups. Useful organic polymeric matte particles and materials used to make them are described for example in Column 5 of U.S. Pat. No.

6,303,281 (Wang et al.) that is incorporated herein by reference. The relative amounts of the various ethylenically unsaturated polymerizable monomers used to prepare the matte particles would be readily determined by a worker skilled in the art. The average size of matte particles can be determined using suitable equipment and many commercial materials are marketed with disclosure of the average particle size. However, if an average particle size is to be measured, especially for organic polymeric matte particles, one can use a commercial Horiba particle analyzer or Coulter counter machine, both of which can be obtained from commercial sources.

The matte particles are generally present in the non-light sensitive layer described herein in an amount of at least 5 $mg/m^2$ to and including 100 $mg/m^2$, or typically in an amount of at least 10 $mg/m^2$ to and including 50 $mg/m^2$.

Each of the acrylate latex polymers useful in the practice of this invention in the non-light sensitive layer generally comprises at least 50 weight % of recurring units (or repeating units) derived from one or more acrylic esters or methacrylic esters, based on the total dry weight of the recurring units. The acrylic ester monomers used for providing these recurring units can be conveniently provided by reacting acrylic acid or methacrylic acid with an alcohol, phenol, or hydroxy substituted ether. The useful polymerizable acrylates generally have up to 20 carbon atoms in the ester groups, or from 1 to 10 carbon atoms, or more likely 2 to 6 carbon atoms.

These acrylate latex polymers can comprise two or more different types of recurring units, in random order, and as noted above, more than 50 weight %, and typically at least 80 weight %, or even at least 90 weight %, of the recurring units are derived from one or more acrylic or methacrylic acid ester ethylenically unsaturated polymerizable monomers. In particular, acrylic acid or methacrylic acid esters that are capable of providing homopolymers having a $T_g$ of at least 70° C. are useful.

Examples of useful ethylenically unsaturated polymerizable monomers of this type are described for example, in Columns 4 and 5 of U.S. Pat. No. 5,310,639 (noted above) that is incorporated herein by reference.

Other useful ethylenically unsaturated polymerizable monomers that can provide up to but less than 50 weight %, or up to and including 20 weight %, or even up to and including 10 weight % of the total weight of recurring units can be any of those monomers described in Cols. 5-9 of U.S. Pat. No. 5,310,639 (noted above).

More particularly, each of the acrylate latex polymers useful in the outermost non-light sensitive layer is a copolymer that comprises recurring units derived from at least one of each of the following (a) and (b) groups of ethylenically unsaturated polymerizable monomers:

(a) At least one acrylate monomer (an acrylic or methacrylic acid ester) having an alkyl group having 2 to 6 carbon atoms, such ethyl acrylate, ethyl methacrylate, propyl acrylate, propyl methacrylate, isopropyl acrylate, isopropyl methacrylate, n-butyl acrylate, n-butyl methacrylate, 2-hydroxyethyl methacrylate, and others that would be readily apparent to one skilled in the art, for example as described in U.S. Pat. No. 5,310,639 (noted above).

(b) An ethylenically unsaturated polymerizable monomers such as acrylic acid and methacrylic acid esters, or acrylamides or methacrylamides, having a pendant sulfo or oxosulfo groups, or salts thereof, such as 2-acrylamido-2-methylpropane sulfonic acid, sodium salt, 2-acrylamido-2-methylpropane sulfonic acid, 2-acrylamido-2-methylbutane sulfonic acid, 2-acrylamido-2-methylbutane sulfonic acid, sodium salt, 2-acrylamido-2-methylpropane sulfonic acid, potassium salt, 2-acrylamido-2-propane sulfonic acid, and 2-acrylamido-2-propane sulfonic acid, sodium salt, and other monomers that would be readily apparent to one skilled in the art, for example as described in Cols. 6 and 7 of U.S. Pat. No. 5,310,639 (noted above).

In most embodiments of this invention, the non-light sensitive layer comprises essentially no latex polymers having a glass transition temperature less than 70° C., and essentially no latex polymers that have pendant carboxylic acid or carboxylate groups. By "essentially", it is meant that such latex polymers are present in the non-light sensitive layer in an amount of less than 5 weight %, or even less than 1 weight %, based on the total dry weight of the layer.

A skilled worker in the art would be able to craft the appropriate copolymers from various monomers to obtain the desired glass transition temperatures so the copolymers are useful in the present invention. Some useful acrylate latex polymers are commercially available.

The acrylate latex polymers useful in the outermost non-light sensitive layer can comprise at least 80 mol % of recurring units derived from one or more (a) group monomers, at least 2 mol % of recurring units derived from one or more (b) group monomers, and optionally up to 10 mol % of recurring units derived from one or more monomers other than (a) and (b) group monomers, all based on the total recurring units in the acrylic latex polymer.

The one or more hydrophilic colloids used in the outermost non-light sensitive layer can be any of those described above for the interlayers or other layers in the color photographic elements, but particular it is gelatin that is present in an amount of at least 200 $mg/m^2$ and to and including 1,000 $mg/m^2$.

The non-light sensitive layers used in the color photographic elements can also include other materials that are generally included in such layers including but not including UV absorbers, lubricants, waxes, surfactants, coupler solvents.

Thus, in certain embodiments of the color photographic elements:

the blue light sensitive color record comprises a single blue light sensitive silver halide emulsion layer comprising a gelatin as the hydrophilic colloid, one or more yellow dye image forming color couplers, and silver halide grains having at least 95 mol % chloride and up to 2 mol % of iodide, based on the total grain silver, the green light sensitive color record comprises a single green light sensitive silver halide emulsion layer comprising a gelatin as the hydrophilic colloid, one or more magenta dye image forming color couplers, and silver halide grains having at least 95 mol % chloride and up to 2 mol % of iodide, based on the total grain silver, the red light sensitive color record comprises a single red light sensitive silver halide emulsion layer comprising gelatin as the hydrophilic colloid, one or more cyan dye image forming color couplers, and silver halide grains having at least 95 mol % chloride and up to 2 mol % of iodide, based on the total grain silver, and the non-light sensitive layer is an outermost non-light sensitive layer that comprises a gelatin as a hydrophilic colloid, crosslinked polymeric matte particles having an average size of at least 1 μm to and including 15 μm, the dry weight ratio of the total acrylate latex polymers to the hydrophilic colloid is at least 0.8:1 to and including 3:1, the dry weight ratio of the total acrylate latex polymers to the total matte particles is at least 20:1 to and including 50:1, and each of the acrylate latex polymers comprises recurring units derived from:

(a) one or more acrylic acid or methacrylic acid esters, and (b) one or more an ethylenically unsaturated polymerizable monomers having a pendant sulfo or oxysulfo group or salt thereof.

The color photographic elements of this invention can be provided as a number of commercial products including but not limited to, color papers that are commercially available from Eastman Kodak Company include but are not limited to EKTACOLOR EDGE and ENDURA™ Premier Color Papers, KODAK Photobook Papers, as well as FUJICOLOR Crystal Archive Color Papers (available from Fujifilm). However, the color photographic elements can be modifications of any of these commercial products to achieve the desired benefit of reducing the scratching problem described above.

Processing Conditions and Solutions

The color photographic elements of this invention can be suitably imaged by exposure to any suitable analog or digital source of radiation. For example, analog exposure can be provided by a suitable lamp such as a tungsten lamp. A digital means for exposure includes a digital writer comprising a laser, light emitting diode (LED) beam, or cathode ray tube (CRT) of appropriate spectral radiation to which the color photographic element is sensitive to provide an imagewise exposed color photographic element having a latent color positive image. Imagewise exposure at ambient, elevated or reduced temperatures or pressures can be used within the useful response range of the color photographic element determined by known sensitometric techniques and equipment. Some useful digital exposure means and procedures are described in U.S. Pat. No. 6,838,230 (Wan et al.) that is incorporated herein by reference.

Once imagewise exposed, the imagewise exposed color photographic element is "processed" to provide a color positive image from the latent color positive image. Processing is a well known procedure and there are a number of suitable processing chemistries available to one skilled in the art including KODAK EKTACOLOR RA-4 processing chemistry that include color development using a suitable color developing solution containing a color developing agent, fixing using a fixing solution, and rinsing the final color print. Each processing chemistry is used at recommended times and temperatures for the given steps, which conditions would be readily known to one skilled in the art. Other processing conditions and chemistry is described for example, in U.S. Pat. Nos. 6,077,651 (Darmon et al.), 6,228,567 (Darmon et al.), 6,428,946 (Buongiorne et al.), 6,664,036 (Darmon et al.), 6,838,230 (noted above), and 7,118,850 (Fujita et al.), and U.S. Patent Application 2001/0055734 (Tappe et al.), all of which are incorporated herein by reference.

After processing to form color photographic prints, the resulting color positive image can be used in any suitable manner, including assembling it image into a photobook, with or without other color positive images.

Alternatively, the resulting color positive image can be electronically transmitted or displayed using various electronic or display devices for storage, viewing, or image manipulation.

The following Examples are provided to illustrate the practice of this invention and are not meant to be limiting in any manner.

INVENTION EXAMPLE 1

Color photographic element 101 was prepared by coating the following layers on a corona discharge-treated, polyethylene-coated paper support (all amounts are dry coverage):

| | mg/m$^2$ |
|---|---|
| Layer 1 (Blue light-sensitive silver halide emulsion layer): | |
| Blue light sensitive silver halide emulsion AG-1 (3D 0.60 μm, $AgCl_{0.998}I_{0.002}$, grains having sensitizing dye SD-1) | 192.8 |
| Yellow coupler Y-1 | 406.1 |
| Light stabilizer ST-1 | 37.5 |
| Light stabilizer ST-2 | 37.5 |
| Light stabilizer ST-3 | 37.5 |
| Coupler solvent S-1 | 146.2 |
| Gelatin | 848.5 |
| Layer 2 (Lower Interlayer): | |
| $D_{ox}$ scavenger D-1 | 98.0 |
| Coupler solvent S-2 | 147.0 |
| Gelatin | 571.2 |
| Layer 3 (Green light-sensitive silver halide emulsion layer): | |
| Green light sensitive silver halide emulsion AG-2 (3D 0.35 μm, AgCl, grains having sensitizing dye SD-2) | 86.0 |
| Magenta coupler M-1 | 158.4 |
| Light stabilizer ST-3 | 12.4 |
| Coupler solvent S-2 | 247.6 |
| Coupler solvent S-3 | 180.2 |
| Coupler solvent S-4 | 67.3 |
| Gelatin | 1175.6 |
| Layer 4 (Upper Interlayer): | |
| $D_{ox}$ scavenger D-1 | 90.4 |
| Coupler solvent S-2 | 135.6 |
| Gelatin | 527.3 |
| Layer 5 (Red light-sensitive silver halide emulsion layer): | |
| Red light sensitive silver halide emulsion AG-3 (3D 0.40 μm, AgCl, grains having sensitizing dye SD-3) | 108.0 |
| Cyan coupler C-1 | 111.4 |
| Cyan coupler C-2 | 55.5 |
| Light stabilizer ST-4 | 50.2 |
| UV absorber UV-1 | 192.8 |
| Coupler solvent S-2 | 405.6 |
| Coupler solvent S-5 | 45.1 |
| Gelatin | 878.7 |
| Layer 6 (UV absorbing layer): | |
| UV absorber UV-1 | 40.9 |
| Coupler solvent S-6 | 19.2 |
| Gelatin | 129.6 |
| Layer 7 (Overcoat layer): | |
| Polydimethylsiloxane | 20.2 |
| Matte particles (average size 10 μm) [poly(methyl methacrylate-co-divinyl benzene) (0.97:0.03 mol ratio) | 67.7 |
| Gelatin | 565.1 |

The various coatings further contained sequestering agents, antifoggants, surfactants, and other addenda as known in the art. The gelatin-containing layers were hardened using bis(vinylsulfonyl methyl)ether at 2.15% of the total gelatin weight.

The various components are identified as follows:
Sensitizing dye SD-1
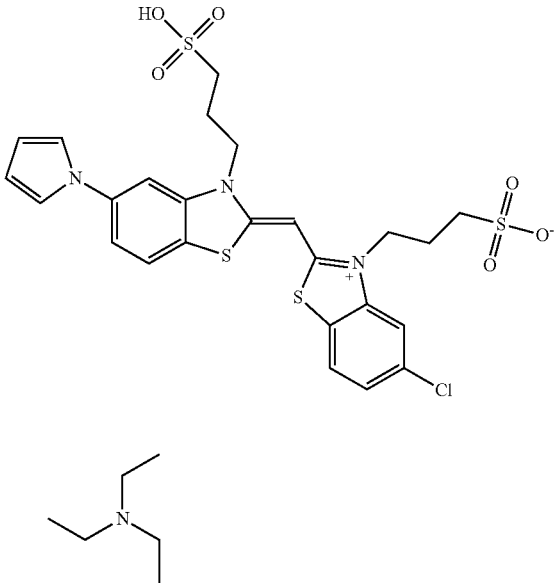
Yellow coupler Y-1
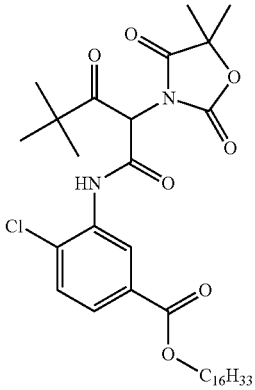
Light stabilizer ST-1
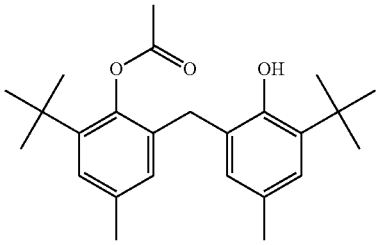
-continued
Light stabilizer ST-2
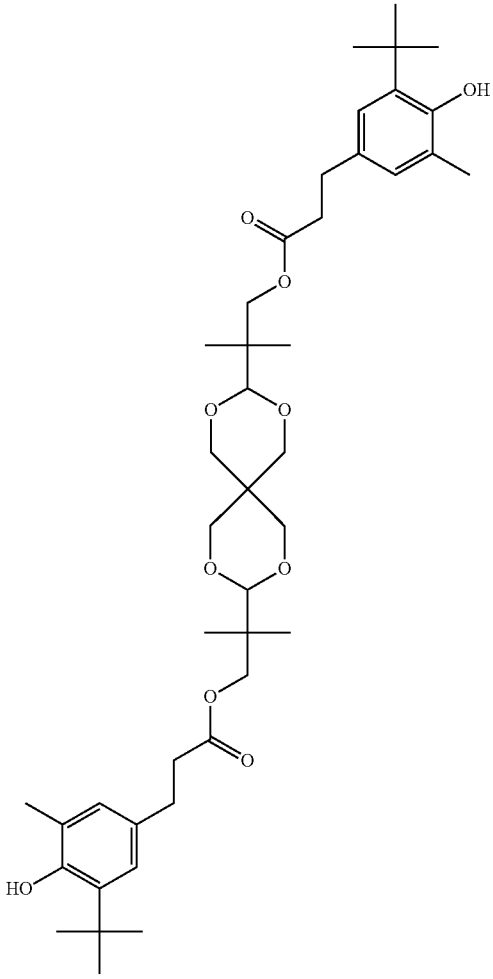
Light stabilizer ST-3
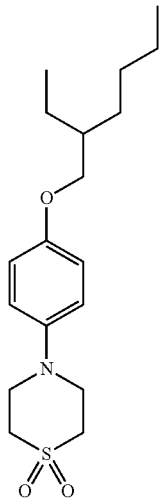

-continued
Coupler solvent S-1
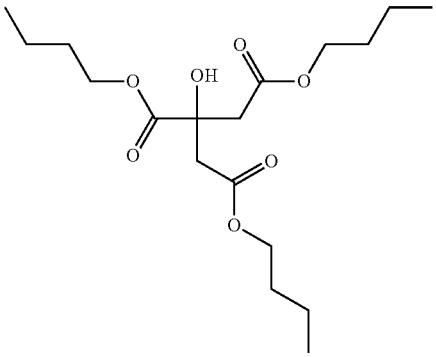
$D_{ox}$ scavenger D-1
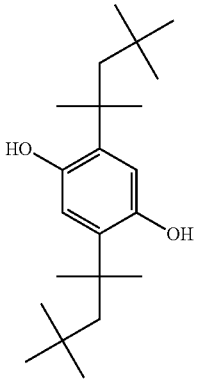
Coupler solvent S-2
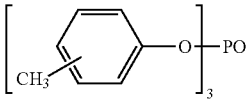
Sensitizing dye SD-2
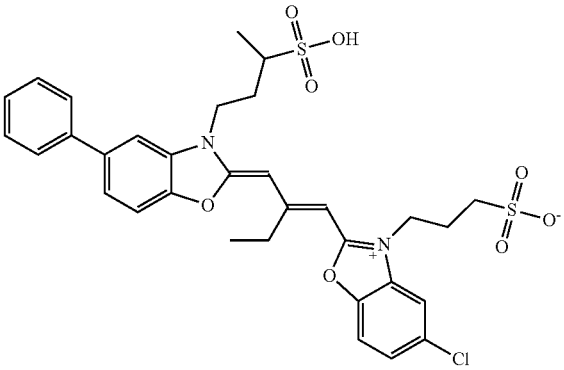
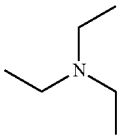
-continued
Magenta coupler M-1
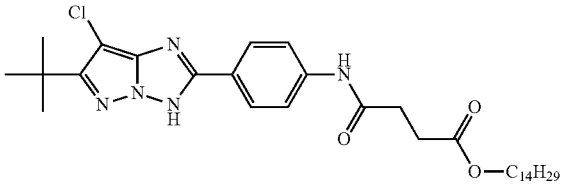
Coupler solvent S-3
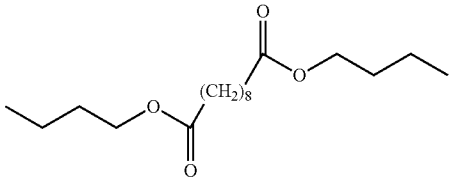
Coupler solvent S-4
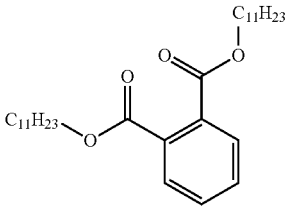
Sensitizing dye S-3
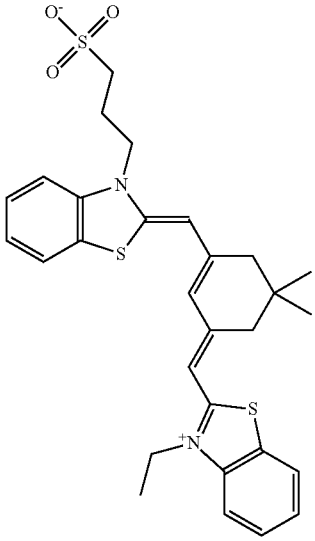

-continued

Cyan coupler C-1

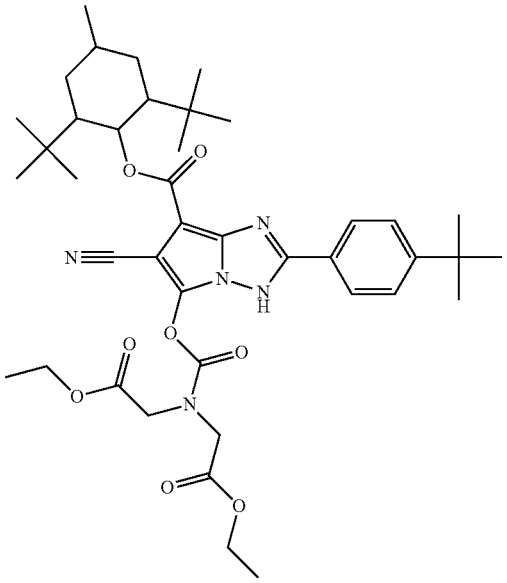

Cyan coupler C-2

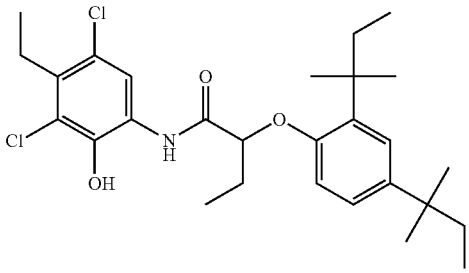

Light stabilizer ST-4

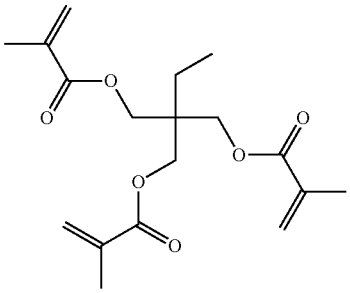

UV absorber UV-1

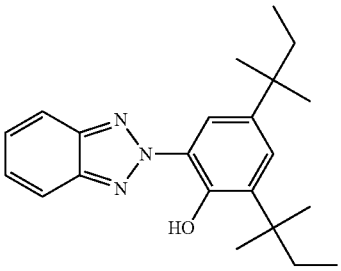

Coupler solvent S-5

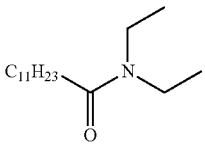

-continued

Coupler solvent S-6

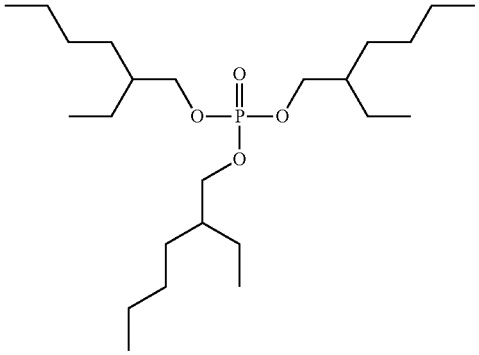

Polymer P-1 was an acrylic latex copolymer derived by polymerization of ethyl methacrylate and 2-acrylamido-2-methylpropane sulfonic acid sodium salt (0.95/0.05 molar ratio), $T_g$=75° C.

Color photographic elements 102 through 113 were similarly prepared except that various formulation changes were made to the overcoat layer (Layer 7) as described in TABLE I below.

Samples of each color photographic element were imagewise exposed to white light and processed using known Kodak EKTACOLOR RA-4 processing chemistry (color development, fixing, and rinsing) as described in the *British Journal of Photography Annual of* 1988, pp 198-199 to achieve a uniform neutral $D_{max}$ image. Each imaged and processed sample (color print) was then creased using a commercial creasing device and then folded as is commonly done when such color prints are put into a photobook. One photobook was made with each element. The finished photobooks were then visually examined for the appearance of scratch marks on the surface of the paper and were given a scratch rating based on the following scale of 1 to 5, where 5 represents several obvious objectionable scratch marks and 1 represents no scratches at all.

TABLE I

Photobook Scratch Mark Ratings

| Element | Description | Scratch Rating |
|---|---|---|
| 101 | | 5 |
| 102 | Added carnauba wax at 20.0 mg/m$^2$ | 5 |
| 103 | Added carnauba wax at 60.0 mg/m$^2$ | 5 |
| 104 | Added cetyl palmitate lubricant at 20.0 mg/m$^2$ | 5 |
| 105 | Added cetyl palmitate lubricant at 60.0 mg/m$^2$ | 5 |
| 106 | Increased Layer 7 gelatin to 847.7 mg/m$^2$ | 5 |
| 107 | Increased Layer 7 gelatin to 1130.2 mg/m$^2$ | 5 |
| 108 | Added Polymer P-1 at 600.0 mg/m$^2$ | 1 |
| 109 | Removed matte particles | 1 |
| 110 | Reduced matte particles to 50.8 mg/m$^2$ | 5 |
| 111 | Reduced matte particles to 33.9 mg/m$^2$ | 4 |
| 112 | Reduced matte particles to 16.9 mg/m$^2$ | 3 |
| 113 | Added Ludox ™ (colloidal silica) particles at 242.2 mg/m$^2$ | 5 |

The results shown in TABLE I indicate that scratch marks were reduced or eliminated with the addition of Polymer P-1 to the overcoat layer or by removal of the matte particles. However, removal of the matte particles entirely was not considered to be a practical option, since they are needed to maintain other important product characteristics. Thus, the best option could be to reduce the amount of matte particles to some degree while incorporating the noted acrylic latex polymer in a desired amount.

INVENTION EXAMPLE 2

Color photographic elements 114 through 121 were similarly prepared, processed, and evaluated as previously described in Invention Example 1. A description of the coating variations and the results of scratch mark evaluations are shown below in TABLE II.

TABLE II

Photobook Scratch Mark Ratings (component levels in mg/m$^2$)

| Element | Matte Particles in Layer 7 | Polymer P-1 in Layer 7 | UV-1 in Layer 6 | Scratch Rating |
|---|---|---|---|---|
| 114 | 67.7 | | 51.0 | 5 |
| 115 | 67.7 | 600.0 | 102.0 | 4 |
| 116 | 16.9 | 600.0 | 51.0 | 2 |
| 117 | 16.9 | 600.0 | 102.0 | 2 |
| 118 | 16.9 | 600.0 | 76.5 | 3 |
| 119 | 16.9 | 400.0 | 102.0 | 3.5 |
| 120 | 16.9 | 200.0 | 102.0 | 4 |
| 121 | 67.7 | | 51.0 | 5 |

These results indicate that the greatest reduction in scratch marks was achieved with the combination of Polymer P-1 and a reduced amount of matte particles in the overcoat layer (Layer 7).

The invention has been described in detail with particular reference to certain preferred embodiments thereof, but it will be understood that variations and modifications can be effected within the spirit and scope of the invention.

The invention claimed is:

1. A color photographic element comprising a reflective support, and having on one side thereof and in order from the reflective support:

a blue light sensitive color record comprising a blue light sensitive silver halide emulsion layer comprising a hydrophilic colloid and a yellow dye image forming color coupler, a first non-light sensitive interlayer comprising a hydrophilic colloid, a green light sensitive color record comprising a green light sensitive silver halide emulsion layer comprising a hydrophilic colloid and a magenta dye image forming color coupler, a second non-light sensitive interlayer comprising a hydrophilic colloid, a red light sensitive color record comprising a light sensitive silver halide emulsion layer comprising a hydrophilic colloid and a cyan dye image forming color coupler, and a non-light sensitive layer comprising:

(1) a hydrophilic colloid in an amount of at least 200 mg/m$^2$ to and including 2,000 mg/m$^2$, (2) matte particles, and (3) an acrylate latex polymer having latex particles having an average size of less than 1 μm and a glass transition temperature of at least 70° C., wherein the dry weight ratio of the acrylate latex polymer to the hydrophilic colloid is at least 0.8:1 and the dry weight ratio of the acrylate latex polymer to the total matte particles is at least 15:1.

2. The color photographic element of claim 1, wherein the acrylate latex polymer is present in the non-light sensitive layer in an amount of at least 200 mg/m$^2$ to and including 2,000 mg/m$^2$.

3. The color photographic element of claim 1, wherein the acrylate latex polymer in the non-light sensitive layer has a glass transition temperature ($T_g$) of at least 70° C. and up to and including 200° C.

4. The color photographic element of claim 1, wherein the non-light sensitive layer is the outermost layer of the color photographic element.

5. The color photographic element of claim 1, wherein the dry weight ratio of the acrylate latex polymer to the hydrophilic colloid is at least 0.8:1 to and including 3:1.

6. The color photographic element of claim 1, wherein the dry weight ratio of the acrylate latex polymer to the total matte particles is at least 20:1 to and including 50:1.

7. The color photographic element of claim 1, wherein the matte particles are crosslinked polymeric particles having an average size of at least 1 μm to and including 15 μm.

8. The color photographic element of claim 1, wherein the acrylate latex polymer in the non-light sensitive layer comprises recurring units derived from:

(a) one or more acrylic acid or methacrylic acid esters, and (b) one or more an ethylenically unsaturated polymerizable monomers having a pendant sulfo or oxysulfo group or salt thereof.

9. The color photographic element of claim 8, wherein the acrylate latex polymer in the outermost non-light sensitive layer comprises at least 80 mol % of recurring units derived from one or more (a) group monomers, at least 4 mol % of recurring units derived from one or more (b) group monomers, and optionally up to 10 mol % of recurring units derived from one or more monomers other than (a) and (b) group monomers, all based on the total recurring units in the acrylate latex polymer.

10. The color photographic element of claim 1, wherein the non-light sensitive layer comprises essentially no latex polymers having a glass transition temperature less than 70° C., and essentially no latex polymers that have pendant carboxylic acid or carboxylate groups.

11. The color photographic element of claim 1 wherein the hydrophilic colloid in the outermost non-light sensitive layer is a gelatin that is present in an amount of at least 200 mg/m$^2$ and to and including 1,000 mg/m$^2$.

12. The color photographic element of claim 1, wherein the blue light sensitive color record comprises a single blue light sensitive silver halide emulsion layer, the green light sensitive color record comprises a single green light sensitive silver halide emulsion layer, and the red light sensitive color record comprises a single light sensitive silver halide emulsion layer.

13. The color photographic element of claim 1, wherein each of the blue light sensitive silver halide emulsion layers, green light sensitive silver halide emulsion layers, and red light sensitive silver halide emulsion layers comprise the same or different silver halide grains comprising at least 90 mol % chloride, and up to 2 mol % of iodide, both based on the total grain silver.

14. The color photographic element of claim 1, wherein:

the blue light sensitive color record comprises a single blue light sensitive silver halide emulsion layer comprising a gelatin as the hydrophilic colloid, one or more yellow dye image forming color couplers, and silver halide grains having at least 95 mol % chloride and up to 2 mol % of iodide, based on the total grain silver, the green light sensitive color record comprises a single green light sensitive silver halide emulsion layer comprising a gelatin as the hydrophilic colloid, one or more magenta dye image forming color couplers, and silver halide grains having at least 95 mol % chloride and up to 2 mol % of iodide, based on the total grain silver, the red light sensitive color record comprises a single red light sensitive silver halide emulsion layer comprising gelatin as the hydrophilic colloid, one or more cyan dye image forming color couplers, and silver halide grains having at least 95 mol % chloride and up to 2 mol % of iodide, based on the total grain silver, and the non-light sensitive layer is an outermost non-light sensitive layer that comprises a gelatin as a hydrophilic colloid, crosslinked polymeric matte particles having an average size of at least 1 μm to and including 15 μm, the dry weight ratio of the total acrylate latex polymers to the hydrophilic colloid is at least 0.8:1 to and including 3:1, the dry weight ratio of the total acrylate latex polymers to the total matte particles is at least 20:1 to and including 50:1, and each of the acrylate latex polymer comprises recurring units derived from:

(a) one or more acrylic acid or methacrylic acid esters, and (b) one or more an ethylenically unsaturated polymerizable monomers having a pendant sulfo or oxysulfo group or salt thereof.

15. A method for providing a color photographic print, comprising:

imagewise exposing the color photographic element of claim 1 to provide an imagewise exposed color photographic element having a latent color positive image, and developing, bleach-fixing, and rinsing the imagewise exposed color photographic element to provide a color positive image from the latent color positive image.

16. The method of claim 15 further comprising assembling the color positive image into a photobook, with or without other color positive images.

17. The method of claim 15, further comprising electronically transmitting or displaying the color positive image.

18. A method for providing a color photographic print, comprising:

imagewise exposing the color photographic element of claim 14 to provide an imagewise exposed color photographic element having a latent color positive image, and developing, bleach-fixing, and rinsing the imagewise exposed color photographic element to provide a color positive image from the latent color positive image.

* * * * *